US009433070B2

(12) United States Patent
Bezel et al.

(10) Patent No.: US 9,433,070 B2
(45) Date of Patent: Aug. 30, 2016

(54) PLASMA CELL WITH FLOATING FLANGE

(71) Applicant: KLA-Tencor Corporation, Milpitas, CA (US)

(72) Inventors: Ilya Bezel, Sunnyvale, CA (US); Anatoly Shchemelinin, Pleasanton, CA (US); Amir Torkaman, San Carlos, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 34 days.

(21) Appl. No.: 14/567,546

(22) Filed: Dec. 11, 2014

(65) Prior Publication Data

US 2015/0201483 A1 Jul. 16, 2015

Related U.S. Application Data

(60) Provisional application No. 61/916,048, filed on Dec. 13, 2013.

(51) Int. Cl.
*H05H 1/24* (2006.01)
*H01J 61/30* (2006.01)
(Continued)

(52) U.S. Cl.
CPC ..... *H05H 1/24* (2013.01); *H01J 61/30* (2013.01); *H01J 61/52* (2013.01); *H01J 65/04* (2013.01)

(58) Field of Classification Search
CPC .... H05H 1/24; H01J 37/32; H01J 37/32009; H01J 37/32018; H01J 37/32431; H01J 37/32467; H01J 61/30; H01J 61/52; H01J 65/04; H05G 2/00; H05G 2/001; H05G 2/003; H05G 2/005; H05G 2/008
See application file for complete search history.

(56) References Cited

U.S. PATENT DOCUMENTS 5,008,593 A 4/1991 Schlie et al.
5,235,251 A 8/1993 Schlie
(Continued)

FOREIGN PATENT DOCUMENTS

JP 2004-304035 A 10/2004
JP 2007-048516 A 2/2007
JP 2007048516 A * 2/2007

OTHER PUBLICATIONS

PCT International Search Report dated Mar. 26, 2015 for International Application No. PCT/US2014/070063. 3 pages.
(Continued)

*Primary Examiner* — Michael Logie
*Assistant Examiner* — David E Smith
(74) *Attorney, Agent, or Firm* — Suiter Swantz pc llo

(57) ABSTRACT

A plasma cell for forming light-sustained plasma includes a transmission element configured to contain a volume of gas, a first terminal flange disposed at or near an opening of the transmission element, a second terminal flange disposed at or near another opening of the transmission element, a floating flange disposed between the first or second terminal flange and the transmission element. The floating flange is movable to compensate for thermal expansion of the transmission element. Further, the floating flange is configured to enclose the internal volume of the transmission element to contain a volume of gas within the transmission element. The transmission element is configured to receive illumination from an illumination source in order to generate plasma within the volume of gas. The transmission element is transparent to a portion of the illumination from the illumination source and a portion of broadband radiation emitted by the plasma.

38 Claims, 10 Drawing Sheets

(51) Int. Cl.
*H01J 61/52* (2006.01)
*H01J 65/04* (2006.01)

(56) References Cited

U.S. PATENT DOCUMENTS 5,829,328 A * 11/1998 Chen ..... B25B 13/102 81/124.5
5,892,328 A * 4/1999 Shang ..... H01J 37/32357 313/17
6,528,760 B1 3/2003 Canella et al.
7,427,571 B2 9/2008 Lindeboom et al.
7,435,982 B2 10/2008 Smith et al.
7,786,455 B2 8/2010 Smith et al.
7,790,596 B2 9/2010 Johnson et al.
8,161,906 B2 4/2012 Kadkhodayan et al.
8,242,695 B2 * 8/2012 Sumitomo ..... H01J 61/025 250/504 R
8,449,715 B2 5/2013 Mitsuhashi et al.
8,704,431 B2 4/2014 Shirasu et al.
2005/0194535 A1 9/2005 Noji et al.
2005/0237529 A1 10/2005 Kanno et al.
2007/0187038 A1 8/2007 Ren et al.
2007/0228288 A1 10/2007 Smith et al.
2007/0228300 A1 * 10/2007 Smith ..... B82Y 10/00 250/504 R
2008/0286489 A1 * 11/2008 Wang ..... H01J 37/32458 427/569
2012/0129299 A1 5/2012 Lin et al.
2013/0106275 A1 5/2013 Chimmalgi et al.
2013/0181595 A1 7/2013 Bezel et al.
2014/0291546 A1 10/2014 Bezel et al.
2015/0034838 A1 2/2015 Bezel et al.

OTHER PUBLICATIONS

U.S. Appl. No. 14/231,196, filed Mar. 31, 2014, Ilya Bezel et al.
U.S. Appl. No. 12/787,827, filed May 26, 2010, Ilya Bezel et al.
P. Spaeh et al., The ITER ECH & CD Upper Launcher: Steps towards final design of the first confinement system, 2013 IEEE 25th Symposium on Fusion Engineering (SOFE), Jun. 10-14, 2013, pp. 1-6, IEEE, San Francisco, CA.

* cited by examiner

PLASMA CELL WITH FLOATING FLANGE

CROSS-REFERENCE TO RELATED APPLICATION

The present application claims the benefit under 35 U.S.C. §119(e) of U.S. Provisional Application Ser. No. 61/916,048, filed Dec. 13, 2013, entitled FLOATING FLANGE CELL DESIGN, naming Ilya Bezel, Anatoly Shchemelinin and Amir Torkaman as inventors, which is incorporated herein by reference in the entirety.

TECHNICAL FIELD

The present invention generally relates to plasma based light sources, and, more particularly, to a plasma cell equipped with one or more floating flanges.

BACKGROUND

As the demand for integrated circuits having ever-small device features continues to increase, the need for improved illumination sources used for inspection of these ever-shrinking devices continues to grow. One such illumination source includes a laser-sustained plasma source. Laser-sustained plasma light sources are capable of producing high-power broadband light. Laser-sustained light sources operate by focusing laser radiation into a gas volume in order to excite the gas, such as argon or xenon, into a plasma state, which is capable of emitting light. This effect is typically referred to as "pumping" the plasma. Typical plasma cell designs fail to provide adequate resistance to high temperature and high pressure environments, compromising the integrity of the seals, the body of the plasma cell and the quality of the atmosphere inside of the plasma cell. Therefore, it would be desirable to provide a system and method for curing defects such as those of the identified above.

SUMMARY

A system for forming light-sustained plasma is disclosed, in accordance with an illustrative embodiment of the present invention. In one illustrative embodiment, the system includes an illumination source configured to generate illumination. In another illustrative embodiment, the system includes a plasma cell. In one illustrative embodiment the plasma cell includes a transmission element having one or more openings and configured to contain a volume of gas; one or more terminal flanges disposed at or near the one or more openings of the transmission element; and one or more floating flanges disposed between at least one of the one or more terminal flanges and the transmission element. In another illustrative embodiment, the one or more floating flanges are movable to compensate for thermal expansion of the transmission element. In another illustrative embodiment, the system includes a collector element arranged to focus the illumination from the illumination source into the volume of gas in order to generate a plasma within the volume of gas contained within the plasma cell. In another illustrative embodiment, the plasma emits broadband radiation. In another illustrative embodiment, the transmission element of the plasma cell is at least partially transparent to at least a portion of the illumination generated by the illumination source and at least a portion of the broadband radiation emitted by the plasma.

A plasma cell for forming a light-sustained plasma is disclosed, in accordance with an illustrative embodiment of the present invention. In one illustrative embodiment, the plasma cell includes a transmission element having one or more openings and configured to contain a volume of gas. In another illustrative embodiment, the plasma cell includes a first terminal flange disposed at or near the one or more openings of the transmission element. In another illustrative embodiment, the plasma cell includes a second terminal flange disposed at or near the one or more openings of the transmission element. In another illustrative embodiment, the plasma cell includes at least one floating flange disposed between at least one the first terminal flange or the second terminal flange and the transmission element. In another illustrative embodiment, the at least one floating flange is movable to compensate for thermal expansion of the transmission element. In another illustrative embodiment, the at least one floating flange is configured to enclose the internal volume of the transmission element in order to contain a volume of gas within the transmission element. In another illustrative embodiment, the transmission element is configured to receive illumination from an illumination source in order to generate a plasma within the volume of gas. In another illustrative embodiment, the plasma emits broadband radiation. In another illustrative embodiment, the transmission element is at least partially transparent to at least a portion of the illumination generated by the illumination source and at least a portion of the broadband radiation emitted by the plasma.

A plasma cell for forming a light-sustained plasma is disclosed, in accordance with an illustrative embodiment of the present invention. In one illustrative embodiment, the plasma cell includes a transmission element having one or more openings and configured to contain a volume of gas. In another illustrative embodiment, the plasma cell includes one or more terminal flanges disposed at or near the one or more openings of the transmission element. In another illustrative embodiment, the plasma cell includes one or more floating flanges disposed between at least one of the one or more terminal flanges and the transmission element, wherein the one or more floating flanges are movable to compensate for thermal expansion of the transmission element. In another illustrative embodiment, the transmission element is configured to receive illumination from an illumination source in order to generate a plasma within the volume of gas. In another illustrative embodiment, the plasma emits broadband radiation. In another illustrative embodiment, the transmission element is at least partially transparent to at least a portion of the illumination generated by the illumination source and at least a portion of the broadband radiation emitted by the plasma.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Figure 1A:
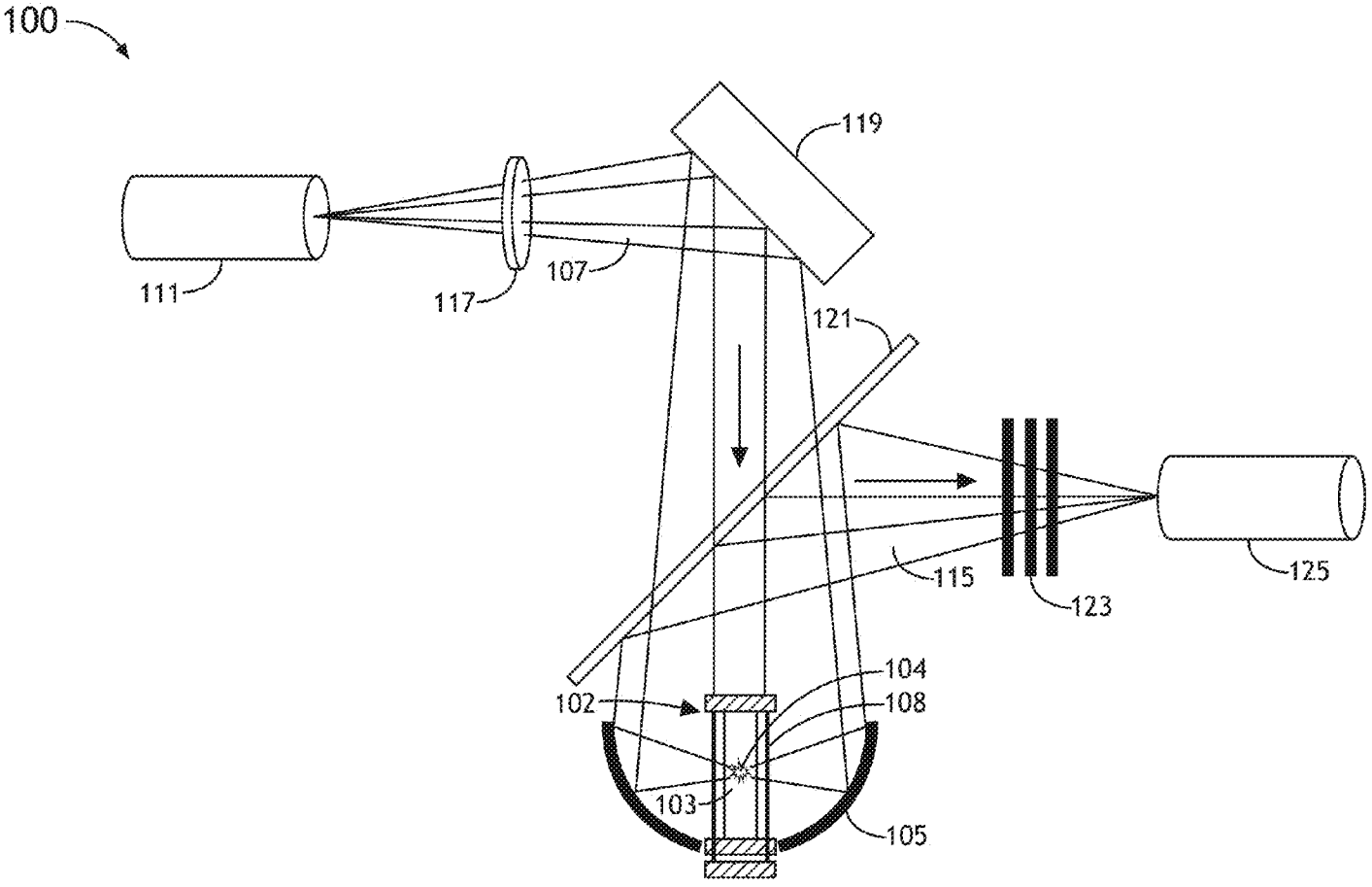
FIG. 1A is a high level schematic view of a system for forming a light-sustained plasma, in accordance with one embodiment of the present invention.

Reference will now be made in detail to the subject matter disclosed, which is illustrated in the accompanying drawings.

Referring generally to FIGS. 1A through 1J, a system for generating a light-sustained plasma is described in accordance with the present disclosure. Embodiments of the present invention are directed to the generation of broadband light with a light-sustained plasma light source. Embodiments of the present invention provide a plasma cell equipped with a transmission element that is transparent to both the pumping light (e.g., light from a laser source) used to sustain a plasma within the plasma cell and broadband light emitted by the plasma. Embodiments of the present invention may provide an intermediate floating flange and/or a compressive sealing element disposed between the transmission element and a terminal flange of the plasma cell. The intermediate floating flange and/or compressive sealing element provide for the compensation of thermal expansion of various components of the plasma cell, such as the transmission element and connecting rods. The connecting rods of the plasma cell of the present disclosure may serve to apply a preload to the various seals of the plasma cell. Embodiments of the present invention may also provide various control elements (e.g., temperature control, convective control and the like) and/or protective elements (e.g., radiation shield and the like) that are coupled to, or integrated with, one or more portions of the plasma cell, such as one or more flanges (e.g., metal flanges or ceramic flanges) and/or caps, which serve to terminate openings of the transmission element of the plasma cell.

It is noted herein that the expansion compensation features provided by the floating flange and compressive sealing element of the plasma cell of the present disclosure allow for the use of many types of materials in the connecting rods, transmission element, and flanges irrespective of thermal expansion coefficients of the given materials. Further, these features also provide for the use of the plasma cell of the present disclosure in an expanded range of temperatures, thermal gradients and internal pressures. The plasma cell of the present disclosure reduces the need to match thermal expansion coefficients for the connecting rods and the transmission element of the plasma cell. It is noted herein that the plasma cell of the present disclosure reduces contact stress on the transmission element from the various seals to a level necessary to avoid damaging the transmission element, while maintaining adequate contact stress for maintaining pressure within the transmission element. Such a configuration allows the plasma cell to operate in a larger range of temperatures and internal pressures.

FIGS. 1A-1J illustrate a system 100 for forming a light-sustained plasma, in accordance with embodiment of the present invention. The generation of plasma within inert gas species is generally described in U.S. patent application Ser. No. 11/695,348, filed on Apr. 2, 2007; and U.S. patent application Ser. No. 11/395,523, filed on Mar. 31, 2006, which are incorporated herein in their entirety. Various plasma cell designs and plasma control mechanisms are described in U.S. patent application Ser. No. 13/647,680, filed on Oct. 9, 2012, which is incorporated herein by reference in the entirety. The generation of plasma is also generally described in U.S. patent application Ser. No. 14/224,945, filed on Mar. 25, 2014, which is incorporated by reference herein in the entirety. Plasma cell and control mechanisms are also described in U.S. patent application Ser. No. 14/231,196, filed on Mar. 31, 2014, which is incorporated by reference herein in the entirety. Plasma cell and control mechanisms are also described in U.S. patent application Ser. No. 14/288,092, filed on May 27, 2014, which is incorporated by reference herein in the entirety. Plasma cell and control mechanisms are also described in U.S. patent application Ser. No. 13/741,566, filed on Jan. 15, 2013, which is incorporated by reference herein in the entirety.

Referring to FIG. 1A, in one embodiment, the system 100 includes an illumination source 111 (e.g., one or more lasers) configured to generate illumination of a selected wavelength, or wavelength range, such as, but not limited to, infrared radiation or visible radiation. In another embodiment, the system 100 includes a plasma cell 102 for generating, or maintaining, a plasma 104. In another embodiment, the system 100 includes a collector/reflector element 105 (e.g., an ellipsoid-shaped collector element) configured to focus illumination emanating from the illumination source 111 into a volume of gas 103 contained within the plasma cell 102.

In another embodiment, the plasma cell 102 includes a transmission element 108. In another embodiment, as shown in FIGS. 1B-1H, the transmission element 108 may have one or more openings 109*a*, 109*b* (e.g., top opening 109*a* and bottom opening 109*b*). In one embodiment, the one or more openings 109*a*, 109*b* may be located at one or more end portions of the transmission element 108. In another embodiment, the first opening 109*a* and the second opening 109*b* are in fluidic communication with one another such that the internal volume of the transmission element 108 is continuous from the first opening 109*a* to the second opening 109*b* For example, as shown in FIGS. 1B-1H, a first opening 109*a* may be located at a first end portion of the transmission element 108, while a second opening 109*b* may be located at a second end portion, opposite of the first end portion, of the transmission element 108.

In another embodiment, as shown in FIGS. 1B-1H, the plasma cell 102 includes one or more terminal flanges 110, 112. In one embodiment, the one or more terminal flanges 110, 112 are disposed at or near the one or more openings 109*a*, 109*b* of the transmission element 108. For example, the plasma cell 102 may include, but is not limited to, a first terminal flange 110 (e.g., top flange) and a second terminal flange (e.g., bottom flange).

In another embodiment, the plasma cell 102 includes one or more floating flanges 113. For example, a floating flange 113 may be disposed between a terminal flange, such as terminal flange 112, and the transmission element 108. In one embodiment, the one or more floating flanges 113 are movable. In this regard, the movement of the one or more floating flanges 113 provides for the compensation of the thermal expansion of one or more components of the plasma cell 102, such as, but not limited to, the transmission element 108. In this regard, the floating flange 113 may be thought of as an intermediate flange located between a terminal flange (e.g., flange 110, 112) and the transmission element 108 of the plasma cell 102.

In one embodiment, the transmission element 108 is configured to contain a volume of gas 103. In one embodiment, the first terminal flange 110 (or the second terminal flange 112) and the floating flange 113 are configured to enclose the internal volume of the transmission element 108 so as to contain a volume of gas 103 within the body of the transmission element 108. In this regard, the first terminal flange 110 and the floating flange 113 may be closed so as to create a closed volume when the flanges are in contact with the transmission element 108. It is noted herein that the closed volume of the plasma cell 102 may also be formed with one or more caps, such as caps 134 and 136 depicted in FIG. 1J, described further herein. In one embodiment, the plasma cell includes a first cap 134 couplable to the first terminal flange 110 via mounting screws 138. In another embodiment, the plasma cell 102 includes a second cap 136 couplable to the second flange 112 via mounting screws 140. In one embodiment, the first cap 134 and the second cap 136 are configured to enclose the internal volume of the transmission element 108 so as to contain a volume of gas 103 within the body of the transmission element 108. In this regard, the first terminal flange 110 and the floating flange 113 may be open so as to create a closed volume when the caps 134, 136 are in contact with the first terminal flange 110 and the second terminal flange 112

In another embodiment, the plasma cell 102 includes a compressive sealing element 122 disposed within a gap between the one or more floating flanges 113 and the one or more terminal flanges 110, 112. In one embodiment, the compressive sealing element 122 includes an incompletely compressed seal. For example, the compressive sealing element 122 includes, but is not limited to, an incompletely compressed C-ring seal (e.g., metal C-ring seal), an E-ring seal (e.g., metal e-ring seal) or O-ring seal (e.g., metal O-ring seal). By way of another example, the compressive sealing element 122 includes, but is not limited to, a bellows.

It is noted herein that the compressive sealing element 122 may provide a seal between the transmission element 108 and the floating flange 113, while also allowing for thermal expansion of the various components (e.g., transmission element 108) of the plasma cell 102. For example, thermal expansion of the transmission element 108 may cause the displacement of the floating flange 113 (e.g., displacement along vertical direction in FIG. 1B-1H), which in turn, compresses the compression sealing element 122. Such a configuration provides for minimal, or at least reduced, compressive stress, thereby allowing for an increased range in operating temperatures and tolerable thermal gradients in one or more components (e.g., transmission element 108, connecting rods 118 and the like) of the plasma cell 102 without breaking the seal between the transmission element 108 and the floating flange 113.

In another embodiment, as shown in FIGS. 1B-1H, the plasma cell 102 includes one or more seals 114. In one embodiment, the seals 114 are configured to provide a seal between the body of the transmission element 108 and the one or more terminal flanges, such as terminal flange 110, and the floating flange 113. The seals 114 of the plasma cell 102 may include any seals known in the art. For example, the seals 114 may include, but are not limited to, a brazing, an elastic seal, an O-ring, a C-ring, and E-ring and the like. In one embodiment, the seals 114 may include one or more metals or metal allows. For example, the seals 114 may include a soft metal alloy, such as, but not limited to, an indium-based alloy. In another embodiment, the seals 114 may include an indium-coated C-ring.

In another embodiment, one or more of the first terminal flange 110, the second terminal flange 112 or the floating flange 113 includes one or more coolant channels 116. For example, the coolant channels 116 may be configured to circulate a gas or liquid in order to cool the given flange. For instance, the coolant channels 116 may circulate water, air or any other suitable heat exchange fluid. In one embodiment, the coolant channels 116 of a given flange may be fluidically coupled to an external coolant source, along with other coolant system components.

It is noted herein that thermal management of the transmission element 108 and the flanges is required for high-power cell operation. For example, low temperature of the seal areas may be required if indium is used as the seal material, which has a melting temperature of 156.6° C. It is noted that operating operation conditions of glass bulbs without the thermal management of the present disclosure may reach many hundreds of degrees Celsius. Thermal management of the top and bottom flanges 110, 112 can be achieved through thermal coupling of the flanges with cooled end caps 132, 134 (e.g., water cooled end caps). It is further noted that the floating flange 113 may require separate cooling (e.g., water cooling), since thermal conductivity through the compressive sealing element 122 (e.g., C-ring) may not be adequate for the given application. It is further noted that thermal management of the transmission element 108 can be achieved via a conductive cooling pathway across the compressive sealing element 122 to the cooled (e.g., water cooled) components.

It is noted herein that the terminal flanges 110, 112 and/or the floating flanges 113 may be formed from any suitable material known in the art. For example, the terminal flanges 110, 112 and/or the floating flanges 113 may be formed from at least one of a metal or ceramic material.

Figure 1B:
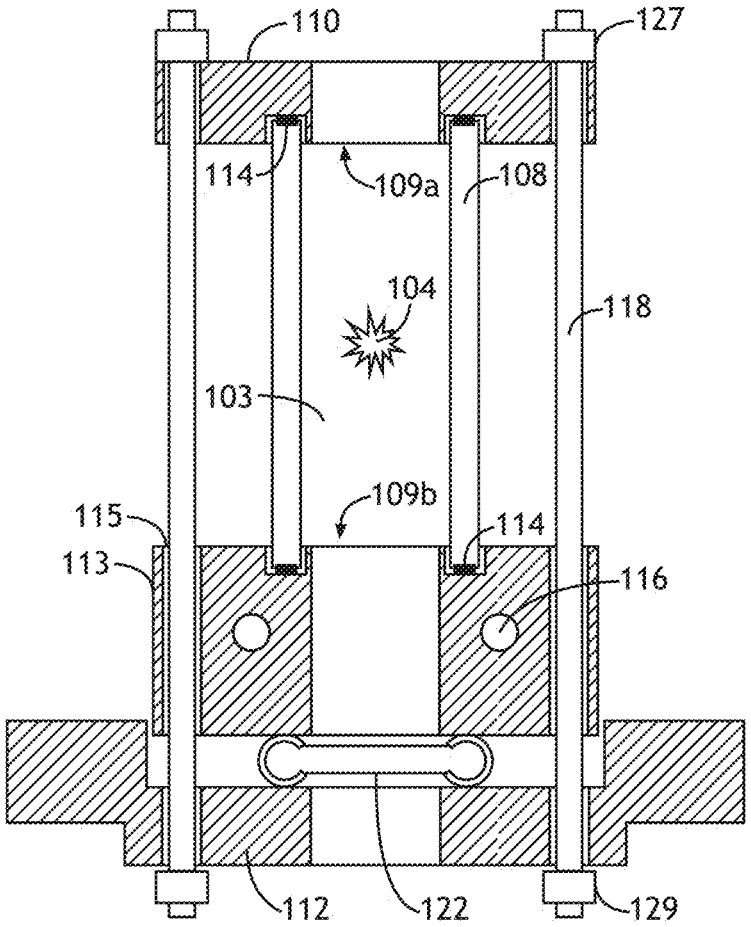
FIG. 1B is a high level schematic view of a plasma cell equipped with connecting rods, in accordance with one embodiment of the present invention.

In another embodiment, as shown in FIG. 1B, the plasma cell 102 includes one or more connecting rods 118. In one embodiment, the one or more connecting rods 118 of the plasma cell 102 may serve to secure the one or more terminal flanges 110, 112 at or near the openings 109*a*, 109*b*. In one embodiment, the one or more connecting rods 118 may secure the one or more terminal flanges 110, 112 with mounting screws 127, 129. In another embodiment, the floating flange 113 includes one or more pass-through holes 115, allowing the one or more connecting rods 118 to mechanically couple the terminal flanges 110 and 112 to each other, as shown in FIG. 1B. In another embodiment, the one or more pass-through holes 115 of the floating flange 113 and the one or more connecting rods 118 are sized to allow movement (e.g., movement along vertical direction in FIG. 1B) of the floating flange 113 upon thermal expansion (or contraction) of the transmission element 108. For example, in the case of a cylindrical transmission element 108, the connecting rods 118 may be coupled to a first flange 109*a* and a second flange 109*b* positioned on the opposite end of the transmission element 108 from the first flange 109*a*. In this regard, the connecting rods 118 serve to provide a mechanical force tending to secure the top flange 110 to the top end of the transmission element 108 and the floating flange 113 (and the connected bottom flange 112) to the bottom end of the transmission element 108.

In another embodiment, as shown in FIG. 1B, the one or more connecting rods 118 of FIG. 1B are configured to provide a preload on the seals 114 and/or the compressive sealing element 122. In this regard, the one or more connecting rods 118 serve to provide a compressive stress to the transmission element 108, allowing sealing of the transmission element 108. It is noted that this compressive stress on the seals 114 and the transmission element 108 allows for maintaining the seals at high operating pressure inside the volume 103 of the plasma cell 102.

The small amount of elasticity of the compressive sealing element 122 allows for compensation of thermal expansion of the transmission element 108 and connecting rods 118, which hold the terminating flanges 110, 112 together. Further, the compressive sealing element 122 may provide for compensation of an elongation of the connecting rods caused by the internal gas pressure of the gas within the internal volume 103 of the plasma cell 102. It is noted that the combination of the compressive sealing element 122 and the connecting rods 118 (or fins 124) allows for the large area seal provided by the compressive sealing element 122 to remain compressively stressed, while keeping the magnitude of the stress relatively constant as a function of internal gas pressure of the plasma cell 102 and temperature of the transmission element 108 and connecting rods 118 (or fins 124).

It is further noted that the use of a large area of contact for the seals 114 allows for even distribution of the preload stress across the end transmission element 108 and allows for the use of brittle materials, such as, but not limited to, $CaF_2$. In addition, the use of a large contact area of the seals 114 to both the flanges 110, 112, 113 and transmission element 108 allows good thermal contact between the flanges 110, 112, 113 and the transmission element 108. Such a configuration allows for improved thermal management of the transmission element via conductive cooling through the abutting seals 114.

It is further noted that, in the case where the diameter of the compressive sealing element 122 is larger than the diameter of the seals 114 for the transmission element 108, extra compressive pressure may be applied on the transmission element 108 once internal cell pressure is increased. Such additional pressure may serve to compensate for the loss of compressive pressure on the transmission element 108 due to flexure of connecting rods 118 (or fins 124). Further, the compensating pressure may aid in maintaining the preload on the seals 114 of the transmission element 108 for a larger range of operating pressures.

Figure 1C:
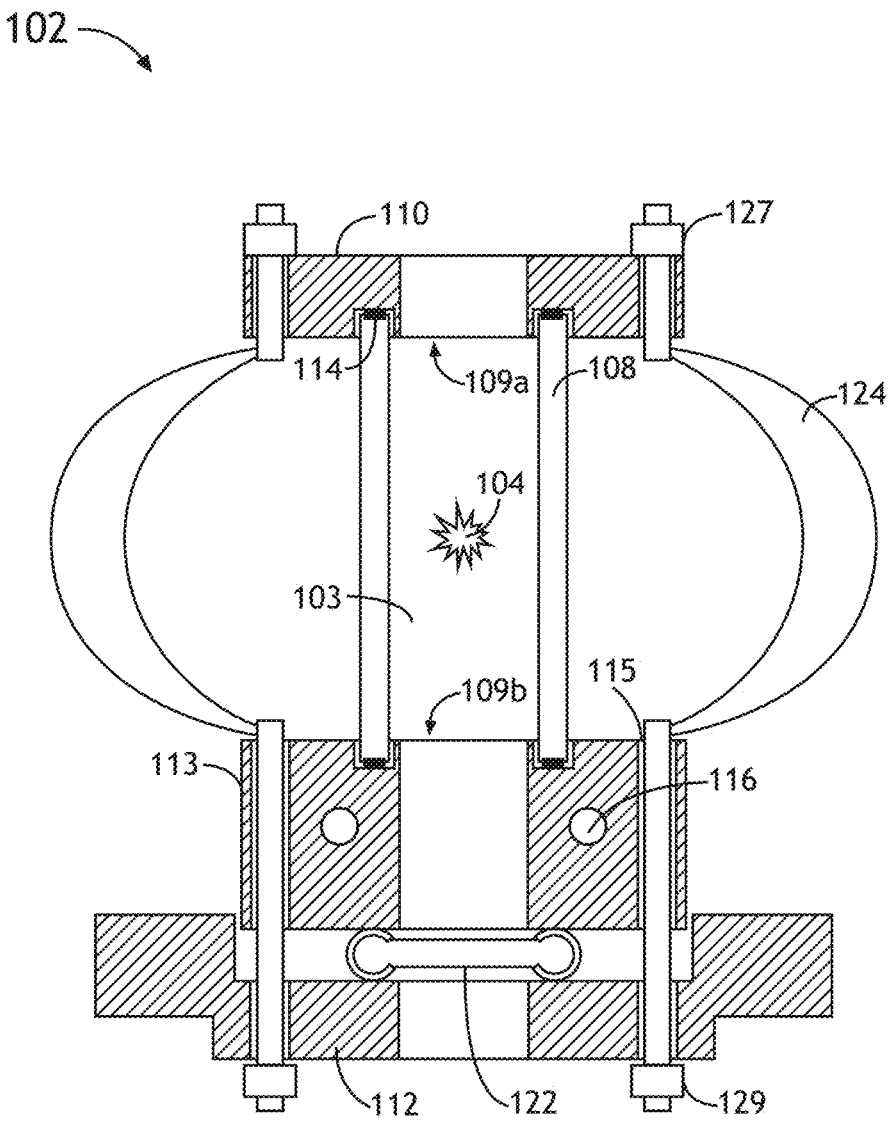
FIG. 1C is a high level schematic view of a plasma cell equipped with fins, in accordance with one embodiment of the present invention.
Figure 1D:
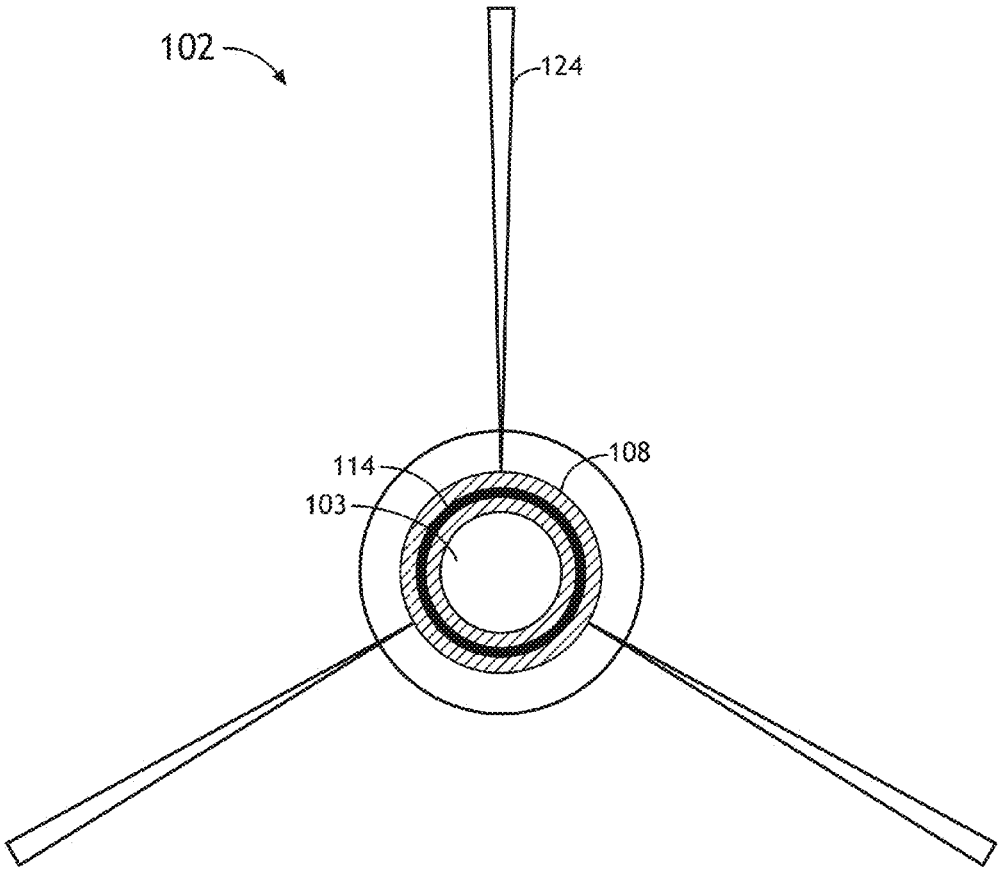
FIG. 1D is an end-on schematic view of a plasma cell equipped with fins, in accordance with one embodiment of the present invention.

In another embodiment, as shown in FIGS. 1C and 1D, the plasma cell 102 includes one or more fins 124. In one embodiment, the one or more fins 124 (e.g., three fins or four fins) of the plasma cell 102 may serve to secure the one or more terminal flanges 110, 112 at or near the openings 109*a*, 109*b* in a manner similar to the connecting rods 118 described previously herein. In one embodiment, the one or more fins 124 may secure the one or more terminal flanges 110, 112 with mounting screws 127, 129. In another embodiment, a rod portion of the one or more fins 124 may pass through pass-through holes 115 and serve to mechanically couple the terminal flanges 110 and 112, as shown in FIG. 1C. In this regard, the fins 124, like the connecting rods 118, serve to provide a mechanical force tending to secure the top flange 110 to the top end of the transmission element 108 and the floating flange 113 (and the connected bottom flange 112) to the bottom end of the transmission element 108. It is further recognized that the fins may be made suitably thin (and/or wedged) in order to limit obscuration between the illumination source 111 and the transmission element 108 and/or the transmission element 108 and the collection element 105. In another embodiment, the fins 124 are configured to cool the plasma cell 102 by transferring thermal energy from one or more portions of the plasma cell 102 to an ambient atmosphere (e.g., surrounding air).

In another embodiment, as shown in FIG. 1C, the one or more fins 124 of FIG. 1C are configured to provide a preload on the seals 114 and/or the compressive sealing element 122. In this regard, the one or more fins 124 serve to provide a contact stress to the transmission element 108, allowing sealing of the transmission element 108. It is again noted that this compressive stress on the seals 114 and the transmission element 108 provided by the fins 124 allows for maintaining the seals at high operating pressure inside the volume 103 of the plasma cell 102.

In one embodiment, the transmission element 108 may contain any selected gas (e.g., argon, xenon, mercury or the like) known in the art suitable for generating plasma upon absorption of suitable illumination. In one embodiment, focusing illumination 113 from the illumination source 111 into the volume of gas 103 causes energy to be absorbed through one or more selected absorption lines of the gas or plasma within the transmission element 108, thereby "pumping" the gas species in order to generate or sustain a plasma. In another embodiment, although not shown, the plasma cell 102 may include a set of electrodes for initiating the plasma 104 within the internal volume 103 of the transmission element 108, whereby the illumination source 113 from the illumination source 111 maintains the plasma 104 after ignition by the electrodes.

In another embodiment, the plasma 104 generated, or maintained, within the volume 103 of the transmission element 108 emits broadband radiation. In one embodiment, the broadband illumination 115 emitted by the plasma 104 includes at least vacuum ultraviolet (VUV) radiation. In another embodiment, the broadband illumination 115 emitted by the plasma 104 includes deep ultraviolet (DUV) radiation. In another embodiment, the broadband illumination 115 emitted by the plasma 104 includes ultraviolet (UV) radiation. In another embodiment, the broadband illumination 115 emitted by the plasma 104 includes visible radiation. For example, the plasma 104 may emit short-wavelength radiation in the range of 120 to 200 nm. In this regard, the transmission element 108 allows the plasma cell 102 of system 100 to serve as a VUV radiation source. In another embodiment, the plasma 104 may emit short-wavelength radiation having a wavelength below 120 nm. In another embodiment, the plasma 104 may emit radiation having a wavelength larger than 200 nm.

The transmission element 108 of system 100 may be formed from any material known in the art that is at least partially transparent to radiation generated by plasma 104. In one embodiment, the transmission element 108 of system 100 may be formed from any material known in the art that is at least partially transparent to VUV radiation generated by plasma 104. In another embodiment, the transmission element 108 of system 100 may be formed from any material known in the art that is at least partially transparent to DUV radiation generated by plasma 104. In another embodiment, the transmission element 108 of system 100 may be formed from any material known in the art that is transparent to UV light generated by plasma 104. In another embodiment, the transmission element 108 of system 100 may be formed from any material known in the art transparent to visible light generated by plasma 104.

In another embodiment, the transmission element 108 may be formed from any material known in the art transparent to radiation 113 (e.g., IR radiation) from the illumination source 111.

In another embodiment, the transmission element 108 may be formed from any material known in the art transparent to both radiation from the illumination source 111 (e.g., IR source) and radiation (e.g., VUV radiation, DUV radiation, UV radiation and visible radiation) emitted by the plasma 104 contained within the volume 103 of the transmission element 108.

For example, the transmission element 108 may include, but is not limited to, calcium fluoride ($CaF_2$), magnesium fluoride ($MgF_2$), crystalline quartz and sapphire, which are capable of transmitting radiation (from the plasma 104) and laser radiation (e.g., infrared radiation) from the illumination source 111. It is noted herein that materials such as, but not limited to, $CaF_2$, $MgF_2$, crystalline quartz and sapphire provide transparency to radiation with wavelengths shorter than 190 nm. For instance, $CaF_2$ is transparent to radiation having a wavelength as short as approximately 120 nm. Further, these materials are resistant to rapid degradation when exposed to short-wavelength radiation, such as VUV radiation. By way of another example, in some instances, fused silica may be utilized to form the transmission element 108. It is noted herein that fused silica does provide some transparency to radiation having wavelength shorter than 190 nm, showing useful transparency to wavelengths as short as 170 nm.

The transmission element 108 may take on any shape known in the art. In one embodiment, the transmission element 108 may have a cylindrical shape, as shown in FIGS. 1A-1H. In another embodiment, although not shown, the transmission element 108 may have a spherical shape. In another embodiment, although not shown, the transmission element 108 may have a composite shape. For example, the shape of the transmission element 108 may consist of a combination of two or more shapes. For instance, the shape of the transmission element 108 may consist of a spherical center portion, arranged to contain the plasma 104, and one or more cylindrical portions extending above and/or below the spherical center portion, whereby the one or more cylindrical portions are coupled to a terminal flange 110, 112 and the floating flange 113.

In the case where the transmission element 108 is cylindrically shaped, the one or more openings 109*a*, 109*b* may be located at one or more end portions of the cylindrically shaped transmission element 108. In this regard, the transmission element 108 takes the form of a hollow cylinder, whereby a channel extends from the first opening 109*a* to the second opening 109*b*. In another embodiment, the flange 110 (or 112) and the floating flange 113 together with the wall(s) of the transmission element 108 serve to contain the volume of gas 103 within the channel of the transmission element 108. It is recognized herein that this arrangement may be extended to a variety of transmission element 108 shapes, as described previously herein.

Figure 1E:
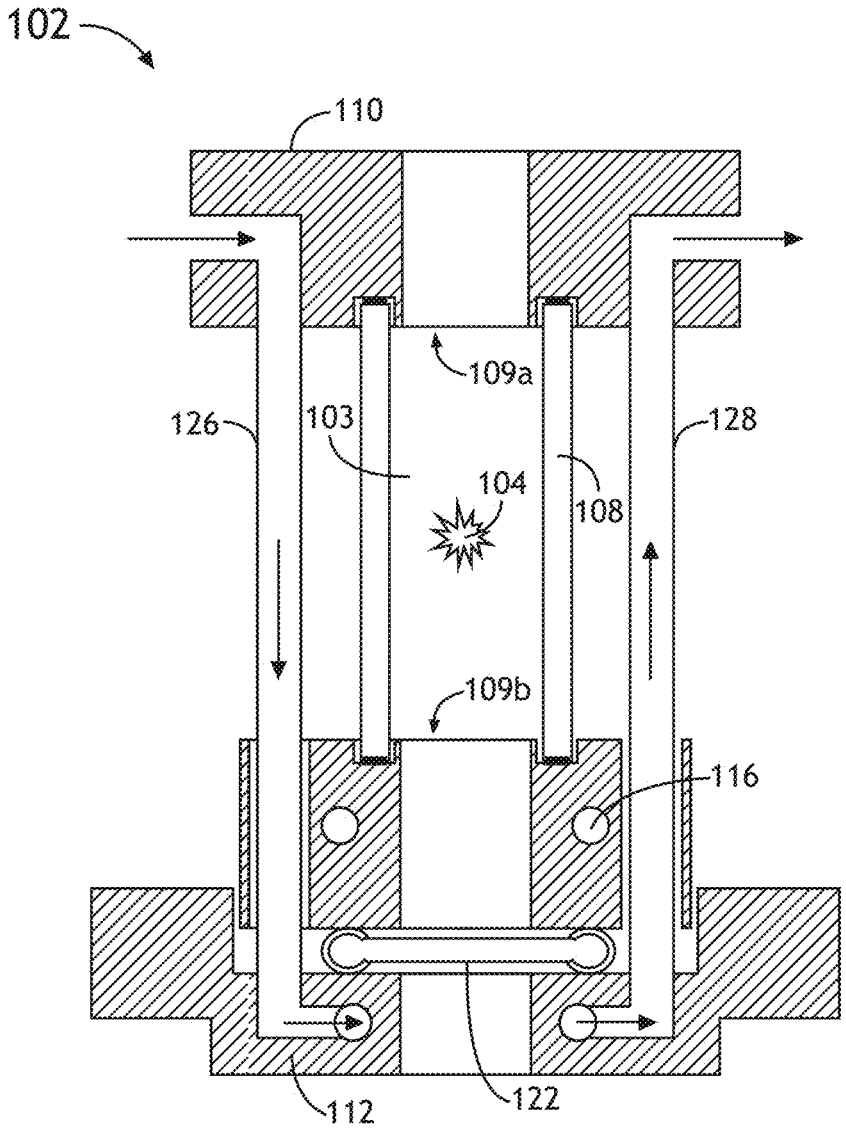
FIG. 1E is a high level schematic view of a plasma cell having one or more coolant transport connecting rods, in accordance with one embodiment of the present invention.
Figure 1F:
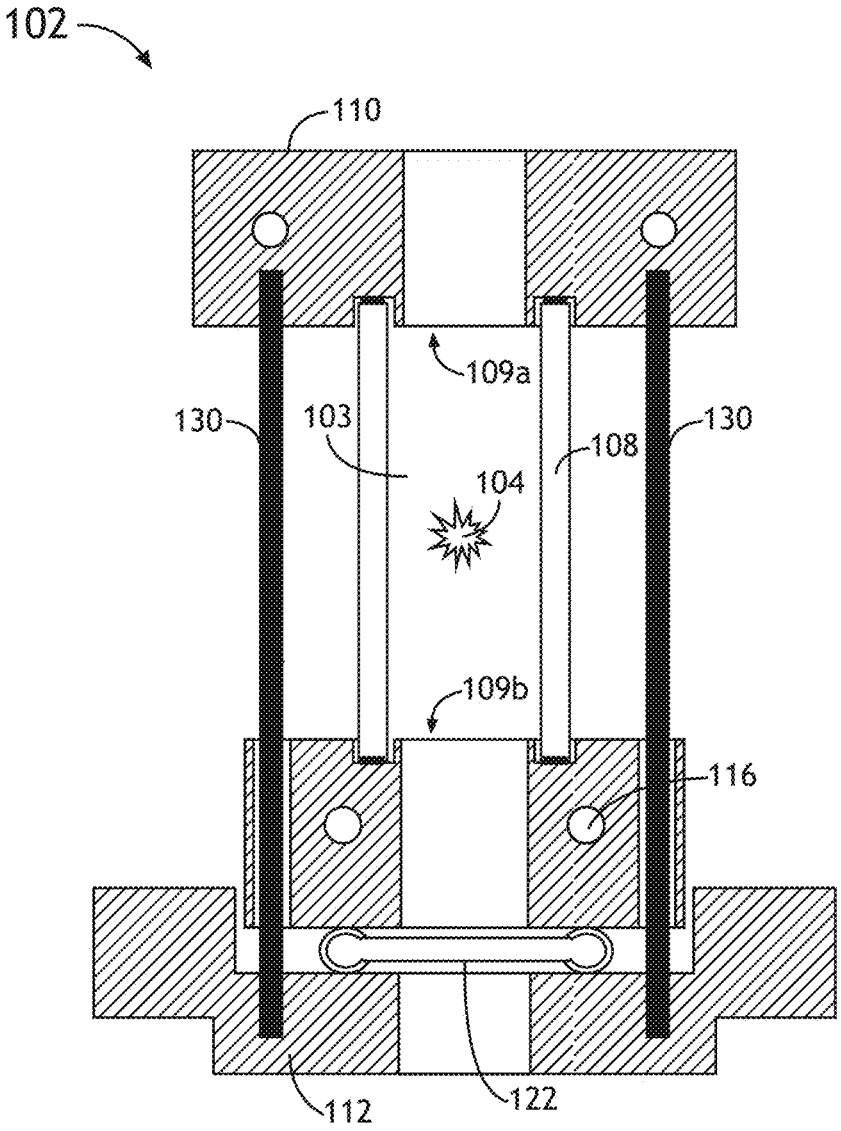
FIG. 1F is a high level schematic view of a plasma cell having one or more heat conduction connecting rods, in accordance with one embodiment of the present invention.

FIGS. 1E and 1F illustrate the plasma cell equipped with one or more active connection rods, in accordance with one or more embodiments of the present invention. It is noted herein that since the plasma cell 102 of the present disclosure does not required the matching of thermal expansion of all structures the connecting rods/fins of the plasma cell 102 can be used to carry out auxiliary functions (e.g., cooling functions).

In one embodiment, as shown in FIG. 1E, the plasma cell is equipped with one or more coolant transport connection rods 126, 128. For example, the coolant transport connection rods 126, 128 may mechanically couple the first terminal flange 110 and the second terminal flange 112. In another embodiment, the coolant transport connection rods 126, 128 are configured to transfer heat from a first flange to a second flange. For example, the coolant transport connection rods 126, 128 may, but are not required to, contain and circulate a coolant such that heat is carried from the bottom terminal flange 112 to the top terminal flange 110. By way of another example, the coolant transport connection rods 126, 128 may, but are not required to, contain and circulate a coolant such that heat is carried from the top terminal flange 110 to the bottom terminal flange 112.

In another embodiment, as shown in FIG. 1F, the plasma cell 102 is equipped with one or more heat conduction rods 130. For example, the heat conduction rods 130 may mechanically couple the first terminal flange 110 and the second terminal flange 112. In another embodiment, the heat conduction rods 130 are configured to transfer heat from a first flange to a second flange. For example, the heat conduction rods 130 may, but are not required to, conduct heat from the bottom terminal flange 112 to the top terminal flange 110. By way of another example, the heat conduction rods 130 may, but are not required to, conduct heat from the top terminal flange 110 to the bottom terminal flange 112.

Figure 1G:
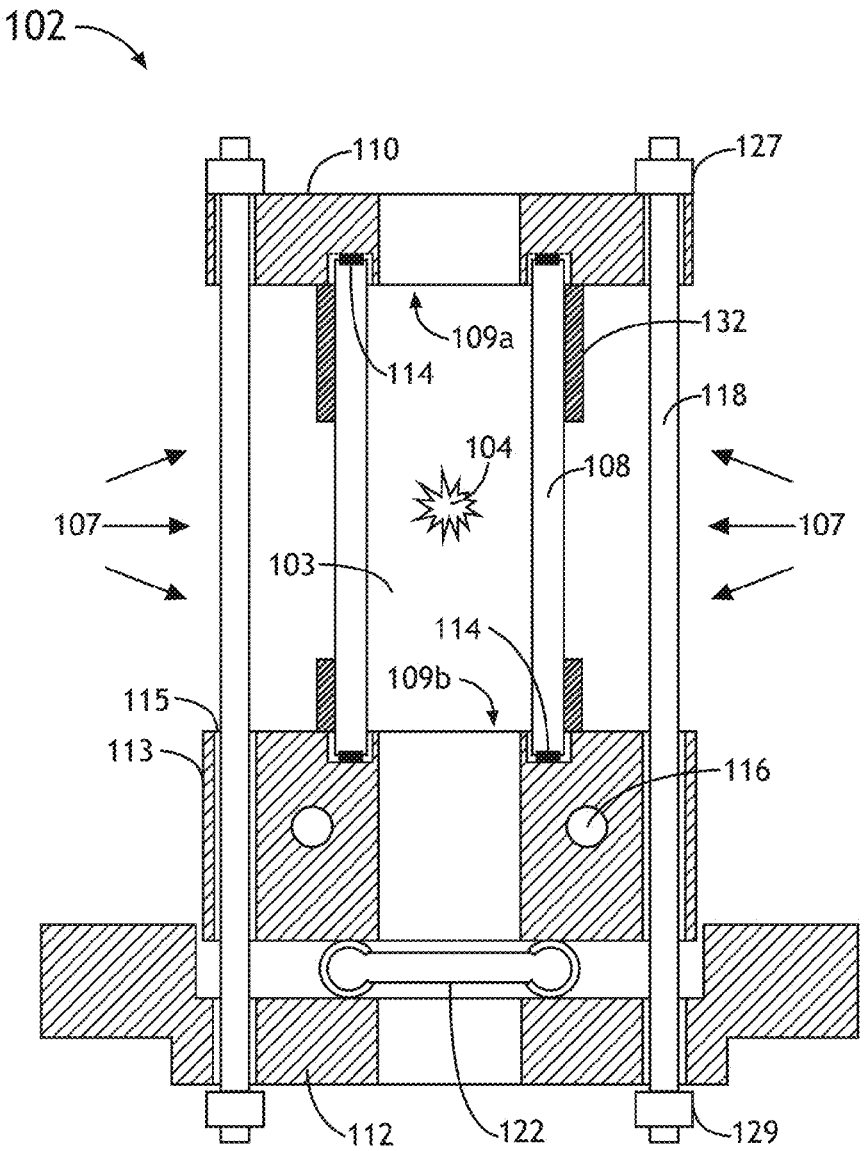
FIG. 1G is a high level schematic view of a plasma cell equipped with one or more radiation shielding elements, in accordance with one embodiment of the present invention.
Figure 1H:
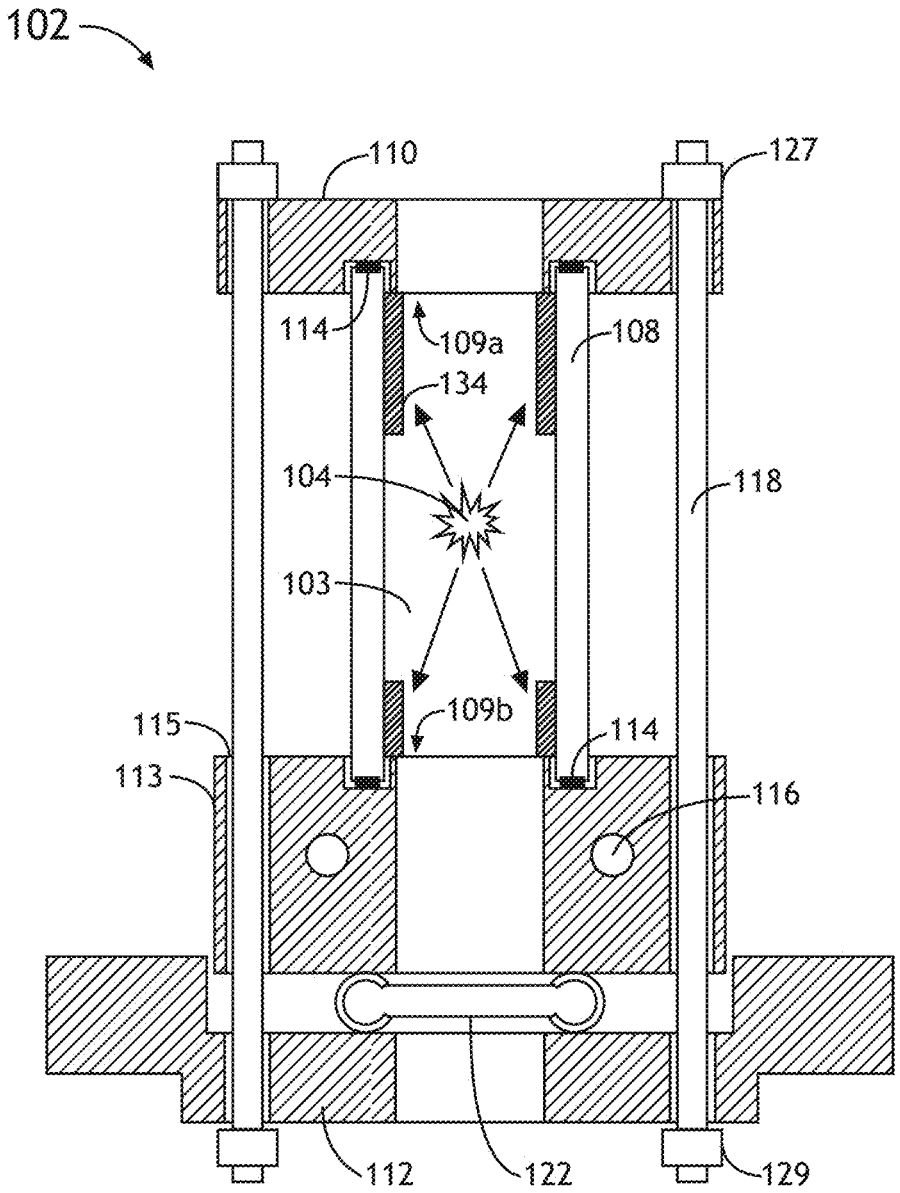
FIG. 1H is a high level schematic view of a plasma cell equipped with one or more radiation shielding elements, in accordance with one embodiment of the present invention.

FIGS. 1G and 1H illustrate the plasma cell 102 equipped with one or more radiation shield elements 132, 134, in accordance with one or more embodiments of the present disclosure. In one embodiment, the one or more radiation shielding elements 132 and/or 134 may include a radiation shield proximate to the one or more openings of the transmission element configured to block radiation from at least one of the illumination source 111 and the radiation generated by the plasma 104 from reaching one or more seals 114 of the plasma cell 102.

In one embodiment, the radiation shielding elements 132 and/or 134 may include a structure suitable for shielding one or more portions of the plasma cell 102 from radiation from the plasma 104 or from the illumination from the light source 111 (e.g., radiation from laser). For example, as shown in FIG. 1G, the one or more radiation shielding elements 132 may be disposed on or near the external surface of the transmission element 108. By way of another example, as shown in FIG. 1H, the one or more radiation shielding elements 134 may be disposed on or near the internal surface of the transmission element 108.

In another embodiment, the one or more radiation shielding elements 132, 134 include a coating material applied to one or more inside or outside portions of the transmission element 108 in order to block radiation from the plasma 104 from one or more selected portions of the plasma cell 102. In another embodiment, the plasma cell 102 may include a coating layer proximate to the one or more openings of the transmission element configured to block at least a portion of the radiation generated by the plasma from reaching one or more seals of the plasma cell. For example, a coating material (e.g., metal material) may be applied to one or more inside or outside end portions of a cylindrical transmission element 108 in order to block radiation (e.g., UV radiation) from the plasma 104 from damaging (or at least limit damage) the seals 114. In another embodiment, an anti-reflective coating material may be applied to one or more inside or outside portions of the transmission element 108 in order to block radiation from the plasma 104 from one or more selected portions of the plasma cell 102. The utilization of radiation shields and radiation blocking coating layers is generally described in U.S. patent application Ser. No. 13/647,680, filed on Oct. 9, 2012, which is incorporated by reference above in the entirety. The utilization of radiation shields and radiation blocking coating layers is generally described in U.S. patent application Ser. No. 14/231,196, filed on Mar. 31, 2014, which is incorporated previously herein by reference in the entirety.

In another embodiment, the plasma cell 102 may include one or more control elements coupled to one or more of the flanges 110, 112, 113. In one embodiment, plasma cell 102 may include one or more control elements for controlling one or more characteristics of the plasma cell 102, the transmission element 108, the gas within volume 103, the plasma 104 and/or a plume from the plasma.

In one embodiment, the one or more control elements coupled to the one or more flanges 110, 112, 113 may include an internal control element. For example, the one or more control elements of the one or more flanges 110, 112, 113 may include an internal control element located within the internal volume of the transmission element 108. In one embodiment, the one or more control elements of the one or more flanges 110, 112, 113 may include an external control element. For example, the one or more control elements of the one or more flanges 110, 112, 113 may include an external control element mounted to a surface of the one or more flanges 110, 112, 113 that is external to the internal volume of the transmission element 108.

In one embodiment, the one or more flanges 110, 112, 113 may include a temperature control element. For example, the temperature control element may be disposed inside or outside of the transmission element 108 of the plasma cell 102. The temperature control element may include any temperature control element known in the art used to control the temperature of the plasma cell 102, the plasma 104, the gas, the transmission element 108, the one or more flanges 110,112, 113 and/or the plasma plume (not shown).

In one embodiment, the temperature control element may be utilized to cool the plasma cell 102, transmission element 108, the plasma 104, the flanges 110, 112, 113 and/or the plume of the plasma by transferring thermal energy to a medium external to the transmission element 108. In one embodiment, the temperature control element may include, but is not limited to, a cooling element for cooling plasma cell 102, transmission element 108, the plasma 104, the gas, the flanges 110,112, 113 and/or the plume of the plasma. For example, as shown in FIGS. 1B-1J, the one or more flanges 110, 112, 113 may include one or more cooling elements 116 (e.g., water cooling elements), as noted previously herein.

In another embodiment, the one or more flanges 110, 112, 113 may include one or more passive heat transfer elements coupled to one or more portions of the one or more flanges 110, 112, 113. For example, the one or more passive heat transfer elements may include, but are not limited to, baffles, chevrons or fins arranged to transfer thermal energy from the hot plasma 104 to a portion of the plasma cell 102 (e.g., top electrode), the one or more flanges 110, 112, 113 or the transmission element 108 to facilitate heat transfer out of the transmission element 108.

The utilization of heat transfer elements is generally described in U.S. patent application Ser. No. 13/647,680, filed on Oct. 9, 2012, which is incorporated by reference above in the entirety. The utilization of heat transfer elements is also generally described in U.S. patent application Ser. No. 12/787,827, filed on May 26, 2010, which is incorporated by reference herein in the entirety. The utilization of heat transfer elements is also generally described in U.S. patent application Ser. No. 14/224,945, filed on Mar. 25, 2014, which is incorporated by reference above in the entirety. The utilization of heat transfer elements is also generally described in U.S. patent application Ser. No. 14/231,196, filed on Mar. 31, 2014, which is incorporated by reference above in the entirety.

In another embodiment, the one or more flanges 110, 112, 113 include one or more convection control elements. For example, a convection control element may be disposed inside or outside of the transmission element 108 of the plasma cell 102. The convection control element may include any convection control device known in the art used to control convection in the transmission element 102. For example, the convection control element may include one or more devices (e.g., structures mechanically coupled to one or more flanges 110,112, 113 and positioned inside transmission element 108) suitable for controlling convection currents within the transmission element 108 of plasma cell 102. For instance, the one or more structures for controlling convection currents may be arranged within the transmission element 108 in a manner to impact the flow of hot gas from the hot plasma region 104 of the plasma cell 102 to the cooler inner surfaces of the transmission element 108. In this regard, the one or more structures may be configured in a manner to direct convective flow to regions within the transmission element 108 that minimize or at least reduce damage to the wall of the transmission element 108 caused by the high temperature gas.

In another embodiment, the cooling elements described previously herein (e.g., water cooling elements 116) may provide convection control, allowing the system 100 to capture, direct and/or dissipate the plasma plume.

The utilization of convection control devices is generally described in U.S. patent application Ser. No. 13/647,680, filed on Oct. 9, 2012, which is incorporated by reference above in the entirety. The utilization of convection control devices are also generally described in U.S. patent application Ser. No. 12/787,827, filed on May 26, 2010, which is incorporated by reference above in the entirety. The utilization of convection control devices is also generally described in U.S. patent application Ser. No. 14/224,945, filed on Mar. 25, 2014, which is incorporated by reference above in the entirety. The utilization of convection control devices is also generally described in U.S. patent application Ser. No. 14/231,196, filed on Mar. 31, 2014, which is incorporated by reference above in the entirety.

Figure 1I:
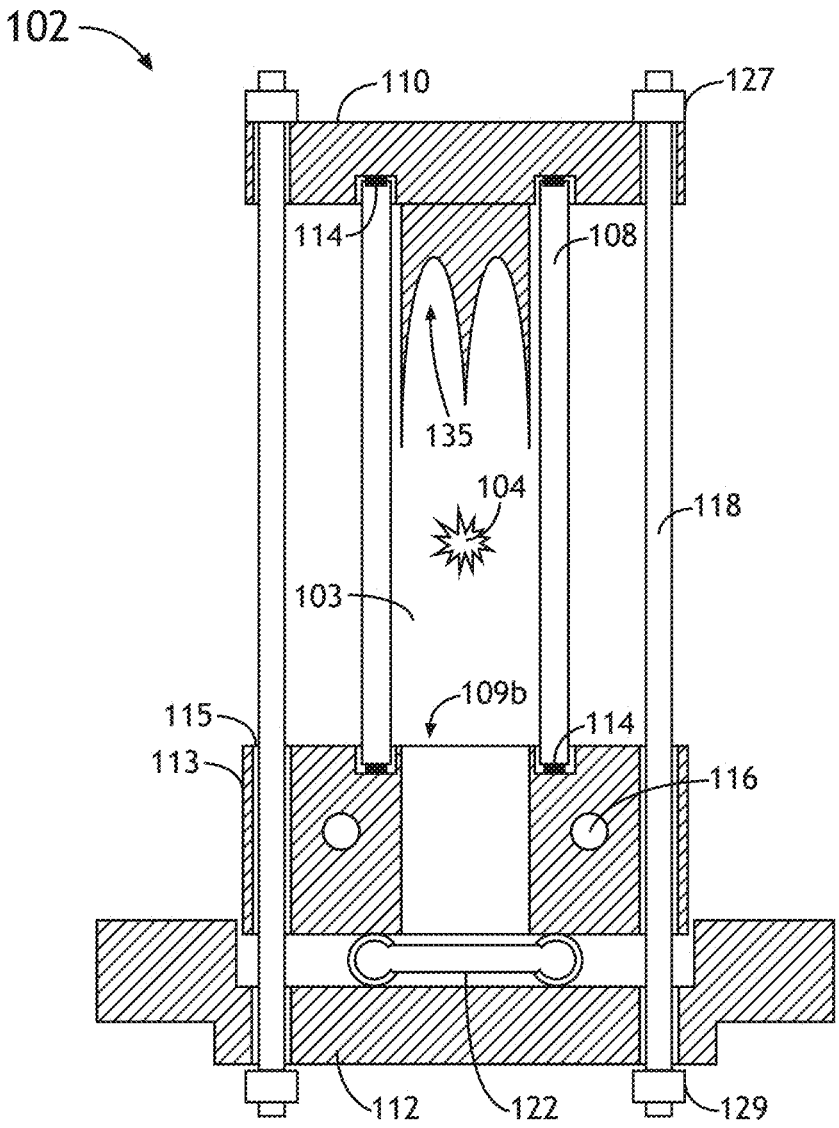
FIG. 1I is a high level schematic view of a plasma cell equipped with one or more plume control elements, in accordance with one embodiment of the present invention.

In another embodiment, as shown in FIG. 1I, the one or more flanges 110, 112, 113 may include one or more plume control devices 135. For example, the plume control device 135 may include a plume capture or redirection device coupled to the one or more flanges 110, 112, 113 and positioned disposed inside of the transmission element 108 of plasma cell 102, as shown in FIG. 1I. The plume control element may include any plume control device known in the art used to capture or redirect the plume of plasma 104 within the transmission element 108. For example, the plume control element may include one or more devices having a concave portion suitable for capturing and redirecting a convection plume emanating from the plasma region 104 within the transmission element 108 of the plasma cell 102. For instance, the plume control element may include one or more electrodes (e.g., top electrode) coupled to the internal surface of one or more flanges 110, 112, 113 and positioned within the transmission element 108 of plasma cell 102 having a concave portion or a hollow portion suitable for capturing and/or redirecting a convection plume emanating from the plasma region 104 within the transmission element of the plasma cell 102. The utilization of plume control devices is generally described in U.S. patent application Ser. No. 13/647,680, filed on Oct. 9, 2012, which is incorporated by reference above in the entirety. The utilization of plume control devices is also generally described in U.S. patent application Ser. No. 12/787,827, filed on May 26, 2010, which is incorporated by reference above in the entirety. The utilization of plume control devices is also generally described in U.S. patent application Ser. No. 14/224,945, filed on Mar. 25, 2014, which is incorporated by reference above in the entirety. The utilization of plume control devices is also generally described in U.S. patent application Ser. No. 14/231,196, filed on Mar. 31, 2014, which is incorporated by reference above in the entirety.

In another embodiment, one or more flanges 110, 112, 113 may include one or more plasma ignition elements. For example, one or more electrodes may be mounted on the internal surface of one or more flanges 110, 112, 113 and positioned within the internal volume of the transmission element 108. The utilization of various electrode configurations is generally described in U.S. patent application Ser. No. 13/647,680, filed on Oct. 9, 2012, which is incorporated by reference above in the entirety. The utilization of various electrode configurations is generally described in U.S. patent application Ser. No. 14/231,196, filed on Mar. 31, 2014, which is incorporated by reference above in the entirety.

In another embodiment, one or more flanges 110, 112, 113 may include one or more sensors (not shown) configured to measure one or more characteristics (e.g., thermal characteristics, pressure characteristics, radiation characteristics and the like) of the plasma cell 102, the transmission element 108, the plasma 104, the gas, the plume of the plasma and the like. In one embodiment, the one or more sensors may include a sensor disposed on the outside or inside surface of one or more flanges 110, 112, 113. For example, the one or more sensors may include, but are not limited to, a temperature sensor, a pressure sensor, a radiation sensor and the like.

Figure 1J:
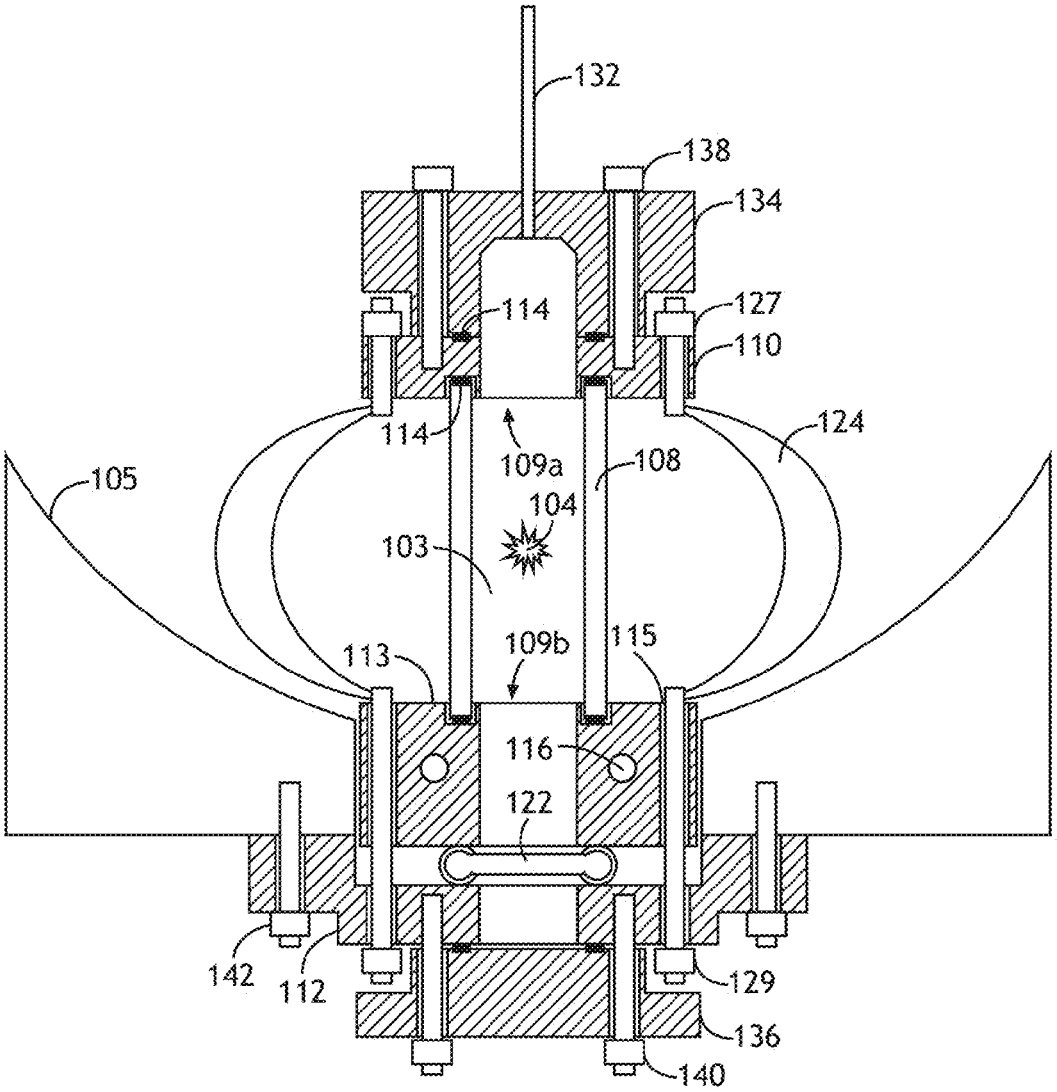
FIG. 1J is a high level schematic view of a plasma cell mounted within the collector/reflector, in accordance with one embodiment of the present invention.

FIG. 1J illustrates a simplified schematic diagram of the plasma cell 102 coupled to the collector 105, in accordance with one or more embodiments of the present invention. In one embodiment, plasma cell 102 is mechanically coupled to the collector via mounting screws 142 or any other suitable mounting device.

In another embodiment, the plasma cell 102 includes one or more gas control elements 132. In one embodiment, a gas control element 132 may be coupled to one or more of the caps 138,140 of the plasma cell. For example, the gas control element 132 may include a feedthrough 132. For instance, the gas control element 132 includes a gas pipe or tube serving to fluidically couple a gas source and the transmission element 108. In another embodiment, the system 100 may include a gas valve positioned along the gas line (between the gas source and the transmission element 108), allowing a user to control the amount and type of gas contained within the transmission element 108. In another embodiment, the gas control element 132 may be coupled to one or more of the flanges 110, 112, 113. The utilization of gas fill devices is generally described in U.S. patent application Ser. No. 13/647,680, filed on Oct. 9, 2012, which is incorporated by reference above in the entirety. The utilization of gas fill devices is generally described in U.S. patent application Ser. No. 14/231,196, filed on Mar. 31, 2014, which is incorporated by reference above in the entirety.

It is noted herein that the feedthrough 132 depicted in FIG. 1J is not limited to a gas feedthrough. It is recognized herein that the plasma cell 102 of the present invention may include any number of feedthroughs. For example, the plasma cell 102 may include, but is not limited to, a gas feedthrough, a cooling feedthrough or an electrical feedthrough. In this regard, any one of the terminal flanges 110, 112, the floating flange 113 or the caps 134, 136 may include feedthroughs allowing gas, coolant or electrical wiring to pass from the outside of the plasma cell 102 to some interior portion of the plasma cell 102.

Referring again to FIG. 1A, the collector element 105 may take on any physical configuration known in the art suitable for focusing illumination emanating from the illumination source 111 into the volume of gas 103 contained within the transmission element 108 of the plasma cell 102. In one embodiment, as shown in FIG. 1A, the collector element 105 may include a concave region with a reflective internal surface suitable for receiving illumination 113 from the illumination source 111 and focusing the illumination 113 into the volume of gas 103 contained within the transmission element 108. For example, the collector element 105 may include an ellipsoid-shaped collector element 105 having a reflective internal surface, as shown in FIG. 1A.

In another embodiment, the collector element 105 is arranged to collect broadband illumination (e.g., VUV radiation, DUV radiation, UV radiation and/or visible radiation) emitted by plasma 104 and direct the broadband illumination to one or more additional optical elements (e.g., filter 123, homogenizer 125 and the like). For example, the collector element 102 may collect at least VUV broadband illumination emitted by plasma 104 and direct the broadband illumination to one or more downstream optical elements. By way of another example, the collector element 105 may collect DUV broadband illumination emitted by plasma 104 and direct the broadband illumination to one or more downstream optical elements. By way of another example, the collector element 105 may collect UV broadband illumination emitted by plasma 104 and direct the broadband illumination to one or more downstream optical elements. By way of another example, the collector element 105 may collect visible broadband illumination emitted by plasma 104 and direct the broadband illumination to one or more downstream optical elements. In this regard, the plasma cell 102 may deliver VUV radiation, UV radiation and/or visible radiation to downstream optical elements of any optical characterization system known in the art, such as, but not limited to, an inspection tool or a metrology tool. It is noted herein the plasma cell 102 of system 100 may emit useful radiation in a variety of spectral ranges including, but not limited to, DUV radiation, VUV radiation, UV radiation, and visible radiation. Further, it is noted herein that the system 100 may utilize any of these radiation bands, while mitigating damage caused to the transmission region 108 by the VUV radiation. In this regard, the transmission element 108 may be formed from a material that is resistant to VUV light, even in cases where the primary purpose of the system 100 does not include the utilization of the VUV light.

In one embodiment, system 100 may include various additional optical elements. In one embodiment, the set of additional optics may include collection optics configured to collect broadband light emanating from the plasma 104. For instance, the system 100 may include a cold mirror 121 arranged to direct illumination from the collector element 105 to downstream optics, such as, but not limited to, a homogenizer 125.

In another embodiment, the set of optics may include one or more additional lenses (e.g., lens 117) placed along either the illumination pathway or the collection pathway of system 100. The one or more lenses may be utilized to focus illumination from the illumination source 111 into the volume of gas 103. Alternatively, the one or more additional lenses may be utilized to focus broadband light emanating from the plasma 104 onto a selected target (not shown).

In another embodiment, the set of optics may include a turning mirror 119. In one embodiment, the turning mirror 119 may be arranged to receive illumination 113 from the illumination source 111 and direct the illumination to the volume of gas 103 contained within the transmission element 108 of the plasma cell 102 via collection element 105. In another embodiment, the collection element 105 is arranged to receive illumination from mirror 119 and focus the illumination to the focal point of the collection element 105 (e.g., ellipsoid-shaped collection element), where the transmission element 108 of the plasma cell 102 is located.

In another embodiment, the set of optics may include one or more filters 123 placed along either the illumination pathway or the collection pathway in order to filter illumination prior to light entering the transmission element 108 or to filter illumination following emission of the light from the plasma 104. It is noted herein that the set of optics of system 100 as described above and illustrated in FIG. 1A are provided merely for illustration and should not be interpreted as limiting. It is anticipated that a number of equivalent optical configurations may be utilized within the scope of the present invention.

It is contemplated herein that the system 100 may be utilized to sustain a plasma in a variety of gas environments. In one embodiment, the gas used to initiate and/or maintain plasma 104 may include an inert gas (e.g., noble gas or non-noble gas) or a non-inert gas (e.g., mercury). In another embodiment, the gas used to initiate and/or maintain a plasma 104 may include a mixture of gases (e.g., mixture of inert gases, mixture of inert gas with non-inert gas or a mixture of non-inert gases). For example, it is anticipated herein that the volume of gas used to generate a plasma 104 may include argon. For instance, the gas 103 may include a substantially pure argon gas held at pressure in excess of 5 atm (e.g., 20-50 atm). In another instance, the gas may include a substantially pure krypton gas held at pressure in excess of 5 atm (e.g., 20-50 atm). In another instance, the gas 103 may include a mixture of argon gas with an additional gas.

It is further noted that the present invention may be extended to a number of gases. For example, gases suitable for implementation in the present invention may include, but are not limited, to Xe, Ar, Ne, Kr, He, $N_2$, $H_2O$, $O_2$, $H_2$, $D_2$, $F_2$, $CH_4$, one or more metal halides, a halogen, Hg, Cd, Zn, Sn, Ga, Fe, Li, Na, Ar:Xe, ArHg, KrHg, XeHg, and the like. In a general sense, the present invention should be interpreted to extend to any light pump plasma generating system and should further be interpreted to extend to any type of gas suitable for sustaining a plasma within a plasma cell.

In another embodiment, the illumination source 111 of system 100 may include one or more lasers. In a general sense, the illumination source 111 may include any laser system known in the art. For instance, the illumination source 111 may include any laser system known in the art capable of emitting radiation in the infrared, visible or ultraviolet portions of the electromagnetic spectrum. In one embodiment, the illumination source 111 may include a laser system configured to emit continuous wave (CW) laser radiation. For example, the illumination source 111 may include one or more CW infrared laser sources. For example, in settings where the gas of the volume 103 is or includes argon, the illumination source 111 may include a CW laser (e.g., fiber laser or disc Yb laser) configured to emit radiation at 1069 nm. It is noted that this wavelength fits to a 1068 nm absorption line in argon and as such is particularly useful for pumping argon gas. It is noted herein that the above description of a CW laser is not limiting and any laser known in the art may be implemented in the context of the present invention.

In another embodiment, the illumination source 111 may include one or more diode lasers. For example, the illumination source 111 may include one or more diode laser emitting radiation at a wavelength corresponding with any one or more absorption lines of the species of the gas contained within volume 103. In a general sense, a diode laser of the illumination source 111 may be selected for implementation such that the wavelength of the diode laser is tuned to any absorption line of any plasma (e.g., ionic transition line) or any absorption line of the plasma-producing gas (e.g., highly excited neutral transition line) known in the art. As such, the choice of a given diode laser (or set of diode lasers) will depend on the type of gas contained within the plasma cell **10*d*2 of system 100**.

In another embodiment, the illumination source 111 may include an ion laser. For example, the illumination source 111 may include any noble gas ion laser known in the art. For instance, in the case of an argon-based plasma, the illumination source 111 used to pump argon ions may include an Ar+ laser.

In another embodiment, the illumination source 111 may include one or more frequency converted laser systems. For example, the illumination source 111 may include a Nd:YAG or Nd:YLF laser having a power level exceeding 100 Watts. In another embodiment, the illumination source 111 may include a broadband laser. In another embodiment, the illumination source may include a laser system configured to emit modulated laser radiation or pulsed laser radiation.

In another embodiment, the illumination source 111 may include one or more non-laser sources. In a general sense, the illumination source 111 may include any non-laser light source known in the art. For instance, the illumination source 111 may include any non-laser system known in the art capable of emitting radiation discretely or continuously in the infrared, visible or ultraviolet portions of the electromagnetic spectrum.

In another embodiment, the illumination source 111 may include two or more light sources. In one embodiment, the illumination source 111 may include or more lasers. For example, the illumination source 111 (or illumination sources) may include multiple diode lasers. By way of another example, the illumination source 111 may include multiple CW lasers. In a further embodiment, each of the two or more lasers may emit laser radiation tuned to a different absorption line of the gas or plasma within the plasma cell 102 of system 100.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically mateable and/or physically interacting components and/or wirelessly interactable and/or wirelessly interacting components and/or logically interacting and/or logically interactable components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A system for forming a light-sustained plasma comprising:

an illumination source configured to generate illumination;

a plasma cell including:

a transmission element having one or more openings and configured to contain a volume of gas;

one or more terminal flanges disposed at or near the one or more openings of the transmission element;

one or more floating flanges disposed between at least one of the one or more terminal flanges and the transmission element, wherein the one or more floating flanges are movable to compensate for thermal expansion of the transmission element; and a collector element arranged to focus the illumination from the illumination source into the volume of gas in order to generate a plasma within the volume of gas contained within the plasma cell, wherein the plasma emits broadband radiation, wherein the transmission element of the plasma cell is at least partially transparent to at least a portion of the illumination generated by the illumination source and at least a portion of the broadband radiation emitted by the plasma.

2. The system of claim 1, further comprising:

one or more compressive elements disposed between the transmission element and the one or more floating flanges, the one or more compressive elements configured to compensate for thermal expansion of the transmission element.

3. The system of claim 2, wherein the one or more compressive elements comprise:

one or more incompletely compressed seals.

4. The system of claim 1, wherein the one or more floating flanges are formed from at a least one of a metal material or a ceramic material.

5. The system of claim 1, wherein the one or more floating flanges include one or more coolant channels configure to flow coolant through the floating flange.

6. The system of claim 1, wherein the one or more openings of the transmission element comprise:

a first opening at a first end of the transmission element; and a second opening at a second end of the transmission element opposite the first end.

7. The system of claim 1, wherein the transmission element has at least one of a substantially cylindrical shape or a substantially spherical shape.

8. The system of claim 1, wherein the transmission element has a composite shape.

9. The system of claim 1, wherein at least one of the one or more terminal flanges or the one or more floating flanges include:

one or more control elements.

10. The system of claim 9, wherein the one or more control elements comprise:

at least one of an internal control element and an external control element.

11. The system of claim 9, wherein the control element comprises:

at least one of a thermal control element, a convection control element, a plume control element, a gas fill control element and an ignition control element.

12. The system of claim 1, wherein the plasma cell includes one or more feedthroughs.

13. The system of claim 12, wherein the one or more feedthroughs pass through at least one of the one or more terminal flanges, the one or more floating flanges or one or more caps.

14. The system of claim 12, wherein the one or more feedthroughs comprise at least one of a gas feedthrough, a cooling feedthrough or an electrical feedthrough.

15. The system of claim 1, wherein the one or more terminal flanges comprise:

a first terminal flange disposed at or near a first opening; and a second terminal flange disposed at or near a second opening.

16. The system of claim 15, further comprising:

one or more connecting rods coupled to the first terminal flange and the second terminal flange and configured to secure the first terminal flange over the first opening and the one or more floating flange over the second opening.

17. The system of claim 16, wherein the one or more connecting rods comprise:

one or more active connecting rods.

18. The system of claim 17, wherein the one or more active connecting rods comprise:

one or more coolant transport rods configured to transport coolant between two or more of the first terminal flange, the second terminal flange, or the one or more floating flanges.

19. The system of claim 16, wherein the one or more active connecting rods comprise:

one or more heat conduction rods.

20. The system of claim 19, wherein the one or more heat conduction rods comprise:

one or more heat conduction rods configured to conduct heat between two or more of the first terminal flange, the second terminal flange, or the one or more floating flanges.

21. The system of claim 15, further comprising:

one or more fins coupled to the first terminal flange and the second terminal flange and configured to secure the first terminal flange over the first opening and the one or more floating flange over the second opening.

22. The system of claim 21, wherein the one or more fins are further configured to transfer thermal energy from a portion of the plasma cell to an ambient atmosphere.

23. The system of claim 1, further comprising:

one or more radiation shielding elements.

24. The system of claim 23, wherein the one or more radiation shielding elements comprise:

a radiation shield proximate to the one or more openings of the transmission element configured to block radiation from at least one of the illumination source and the radiation generated by the plasma from reaching one or more seals of the plasma cell.

25. The system of claim 23, wherein the one or more radiation shielding elements comprise:

a coating layer proximate to the one or more openings of the transmission element configured to block at least a portion of the radiation generated by the plasma from reaching one or more seals of the plasma cell.

26. The system of claim 1, wherein the transmission element is at least partially transparent to radiation between 120 nm and 200 nm.

27. The system of claim 1, wherein the transmission element is at least partially transparent to radiation between 190 nm and 260 nm.

28. The system of claim 1, wherein the transmission element is formed from at least one of calcium fluoride, magnesium fluoride, crystalline quartz, sapphire and fused silica.

29. The system of claim 1, wherein broadband radiation emitted by the plasma further includes at least one of vacuum ultraviolet radiation, deep ultraviolet radiation, ultraviolet radiation and visible radiation.

30. The system of claim 29, wherein the transmission element is at least partially transparent to at least one of vacuum ultraviolet radiation, deep ultraviolet radiation, ultraviolet radiation and the visible radiation.

31. The system of claim 1, wherein the illumination source comprises:

one or more lasers.

32. The system of claim 31, wherein the one or more lasers comprise:

one or more infrared lasers.

33. The system of claim 31, wherein the one or more lasers comprise:

at least one of a diode laser, a continuous wave laser, or a broadband laser.

34. The system of claim 1, wherein the gas comprises:

at least one of an inert gas, a non-inert gas and a mixture of two or more gases.

35. The system of claim 1, wherein the collector element is arranged to collect at least a portion of the broadband radiation emitted by the generated plasma and direct the broadband radiation to one or more additional optical elements.

36. The system of claim 1, wherein the collector element comprises:

an ellipsoid-shaped collector element.

37. A plasma cell for forming a light-sustained plasma comprising:

a transmission element having one or more openings and configured to contain a volume of gas;

a first terminal flange disposed at or near the one or more openings of the transmission element;

a second terminal flange disposed at or near the one or more openings of the transmission element; and at least one floating flange disposed between at least one the first terminal flange or the second terminal flange and the transmission element, wherein the at least one floating flange is movable to compensate for thermal expansion of the transmission element, wherein the at least one floating flange is configured to enclose the internal volume of the transmission element in order to contain a volume of gas within the transmission element, wherein the transmission element is configured to receive illumination from an illumination source in order to generate a plasma within the volume of gas, wherein the plasma emits broadband radiation, wherein the transmission element is at least partially transparent to at least a portion of the illumination generated by the illumination source and at least a portion of the broadband radiation emitted by the plasma.

38. A plasma cell for forming a light-sustained plasma comprising:

a transmission element having one or more openings and configured to contain a volume of gas;

one or more terminal flanges disposed at or near the one or more openings of the transmission element; and one or more floating flanges disposed between at least one of the one or more terminal flanges and the transmission element, wherein the one or more floating flanges are movable to compensate for thermal expansion of the transmission element, wherein the transmission element is configured to receive illumination from an illumination source in order to generate a plasma within the volume of gas, wherein the plasma emits broadband radiation, wherein the transmission element is at least partially transparent to at least a portion of the illumination generated by the illumination source and at least a portion of the broadband radiation emitted by the plasma.

* * * * *